US006518530B2

(12) United States Patent
Heins et al.

(10) Patent No.: US 6,518,530 B2
(45) Date of Patent: Feb. 11, 2003

(54) CURRENT-LIMITING CONTACT ARRANGEMENT

(75) Inventors: Volker Heins, Rheinbach (DE); Axel Wendenius, Hunzel (DE); Stefan Michel, Marienfels (DE); Klaus Ochtinger, Dienethal (DE); Berthold Kraemer, Hunzel (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/912,000

(22) Filed: Jul. 24, 2001

(65) Prior Publication Data

US 2002/0056705 A1 May 16, 2002

Related U.S. Application Data

(63) Continuation of application No. PCT/EP00/11026, filed on Nov. 8, 2000.

(30) Foreign Application Priority Data

Nov. 25, 1999 (DE) ..... 199 56 656

(51) Int. Cl.[7] ..... H01H 9/44
(52) U.S. Cl. ..... 218/38; 218/149
(58) Field of Search ..... 335/6, 16, 147, 335/195; 218/15–16, 22, 29, 30, 34, 149, 151, 156

(56) References Cited

U.S. PATENT DOCUMENTS 2,243,038 A * 5/1941 Ludwig ..... 335/16
4,491,705 A * 1/1985 Hayashit et al. ..... 218/22
4,743,720 A 5/1988 Takeuchi et al.
5,589,672 A * 12/1996 Uchida et al. ..... 218/34

FOREIGN PATENT DOCUMENTS

| | | |
|---|---|---|
| DE | 1885241 | 1/1964 |
| DE | 19715116 | 10/1998 |
| EP | 0231600 | 8/1987 |
| EP | 0419324 | 3/1995 |

* cited by examiner

*Primary Examiner*—Lincoln Donovan
(74) *Attorney, Agent, or Firm*—Davidson, Davidson & Kappel, LLC

(57) ABSTRACT

A current-limiting contact arrangement includes a conductor rail including a stationary contact and including two current loops extending at opposite sides of the conductor rail in respective planes parallel to a center plane of the contact arrangement. A contact arm including a movable contact which can be brought into and out of contact with the stationary contact is provided, the current loops extending in respective planes parallel to a center plane of the contact arrangement and along an entire opening travel of the movable contact. An arc control device including arc splitters and a cassette including a first part and a second part and an insulating material are also provided. The arc splitters are disposed in a positive-locking manner in an interior of the cassette, the contact arm and a part of the conductor rail including the stationary contact extending into the interior of the cassette, and the current loops being disposed in a positive-locking manner at outer walls of the cassette. An assembly of the cassette, the arc splitters and the conductor rail is received in a positive-locking manner by inner surfaces of a switching device enclosure.

11 Claims, 2 Drawing Sheets

CURRENT-LIMITING CONTACT ARRANGEMENT

This is a continuation of PCT Application No. PCT/EP00/11026, with an international filing date of Nov. 8, 2000, the entire disclosure of which is hereby incorporated by reference.

BACKGROUND OF INVENTION

The present invention relates to a current-limiting contact arrangement including a stationary contact, a contact arm having a movable contact which can be brought into and out of contact with the stationary contact, and an arc control device having arc splitters. Contact arrangements of this kind are used, for example, in low-voltage switchgear such as circuit-breakers, miniature circuit-breakers, or motor protection switches.

European Patent Document No. EP-B-0419324 describes a current-limiting contact arrangement composed of two stationary conductor rails which each have one stationary contact and of a contact bridge having two movable contacts which are to be brought into and out of contact with the stationary contacts for closing and opening an electric circuit. The conductor rails each have two current loops extending on both sides along the opening travel of the movable contacts and in planes running parallel to the longitudinally running center plane of the contact arrangement. When the contacts are electrodynamically opened in response to a high short-circuit current, the inductive effect of the short-circuit current flowing through the current loops causes the arcs forming between the opening contacts to be deflected in such a way that they are diverted in an accelerated manner along arc diverters which are connected to the conductor rails and a shared arc diverter which is situated at a distance therefrom, resulting in the extinction of the arcs. The conductor rails, the arc diverters, the guide for the contact bridge as well as a contact pressure spring are supported in the preassembled condition in a centrically arranged insulating base and in insulating shells which are arranged on both sides thereof and parallel to the mentioned center plane, the current loops being received by the outer walls of the insulating shells. This contact arrangement which, on each side, is provided with one arc quenching gap opening toward the outside is received by suitably designed inner surfaces of a switching device enclosure in a positive locking manner. The preassembly of the contact arrangement which requires considerable outlay constitutes a disadvantage. Also described is a contact arrangement composed of a conductor rail featuring a current loop and an arc diverter and of a swivelling contact arm having an arc-diverting horn; however, no details are given on the assembly of this contact arrangement.

European Patent Document No. EP-A-0231600 describes a current-limiting contact arrangement of the species which is composed of a fixed conductor rail featuring a stationary contact and having an arc diverter, of a contact arm having a movable contact, and of an arc control device in the form of an arc splitter pack. The conductor rail features two current loops extending on both sides along the only initial opening travel of the movable contacts and in a curved plane running perpendicularly to the center plane of the contact arrangement. An insulating part is to be slid over the current loops to prevent an arc forming between the opening contacts in the event of a short-circuit current from arcing over to the current loops and which holds an insulated magnet yoke which is to be arranged above current loops and whose magnetic field drives the arc into the quenching device in an accelerated manner over the remaining opening travel of the movable contact. The conductor rail featuring the insulating part, the magnet yoke, and the arc splitter pack are to be mounted individually in a switching device enclosure; no provision is made for a preassembly. A further disadvantage consists in the need for the magnet yoke and in the relatively large width of the contact arrangement necessitated by the shape of the current loops.

SUMMARY OF THE INVENTION

Therefore, an object of the present invention is to provide a contact arrangement which saves space and is favorable from a standpoint of production engineering.

The present invention provides a current-limiting contact arrangement including a conductor rail featuring a stationary contact and having two current loops extending at both sides along the center plane of the contact arrangement, a contact arm having a movable contact which can be brought into and out of contact with the stationary contact, as well as an arc control device having arc splitters. The current loops extend in planes parallel to the center plane and along the entire opening travel of the movable contact. Provision is made for a two-part cassette made of insulating material, the arc splitters being retained in a positive-locking manner in the interior thereof, and the part of conductor rail linked with the stationary contact and the contact arm reaching into the interior thereof, and the current loops being retained in a positive-locking manner at the outer walls thereof. The combination of the cassette provided with the arc splitters and of the conductor rail is received in a positive-locking manner by suitably designed inner surfaces of a switching device enclosure.

Through the accommodation and the positive-locking affixation of the immovable contact elements and of the arc splitters by the two-part cassette, a preassembled subassembly is provided which can be easily inserted into the switching device enclosure. The alignment of the current loops parallel to the center plane and their fixing and insulation against the remaining contact parts by the cassette gives rise to a compact contact arrangement of a small width which, by being relatively enclosed, provides for a favorable flow behavior of the arcing gasses inside, the developing pressure being intercepted in such a manner that material stressing is avoided because of the positive-locking accommodation of the cassette in the switching device enclosure. Due to the substantially enclosed cassette design, moreover, the insulation resistance between non-connected live parts is considerable.

By supporting the cassette all-round, it becomes considerably easier to intercept the internal pressure arising during the occurrence of arcs. The switching device enclosure is preferably composed of a lower-quality insulating material since a noticeable part of the mechanical stress and the greatest part of the thermal stress is taken up by the cassette. The ease of assembly of the cassette subassembly is further improved by the capability of both cassette parts of being snap-connected.

The cassette may be composed of a chamber part which is provided with an exhaust port and used for receiving the arc splitters as well as of cover part which is provided with a passage aperture and used for fixing the arc splitters and for the contact arm, very large clearances and leakage distances between non-connected live parts being formed by the partially nested cassette parts and by the narrow design of the passage aperture.

The arc splitters are preferably retained between strip-like formations of the joined cassette parts. The alignment of these formations and possibly of additional formations or recesses for fixing additional parts in the direction of the molds to be removed leads to a considerable simplification of the molding process.

It is sufficient and favorable for reasons of insulation resistance if the conductor rail reaches into the interior of the cassette through one of the cassette parts only with the stationary contact member. Outer guiding strips ensure a reliable and definite support of the current loops. In terms of manufacture, it is particularly favorable for the current loops to be slid onto the cassette in a straight line.

In the cassette, a stop for intercepting the kinetic energy of the contact arm which is electrodynamically thrown open in the event of a short circuit can easily be affixed inside the cassette. In addition to the arc splitters or in lieu of the arc splitters, insulating parts can be retained in the cassette by suitable formations, the insulating parts releasing quenching gasses during the occurrence of arcs.

BRIEF DESCRIPTION OF THE DRAWINGS

Further details and advantages of the present invention are elaborated upon below based on exemplary embodiments with reference to the drawings.

DETAILED DESCRIPTION

Figure 1:
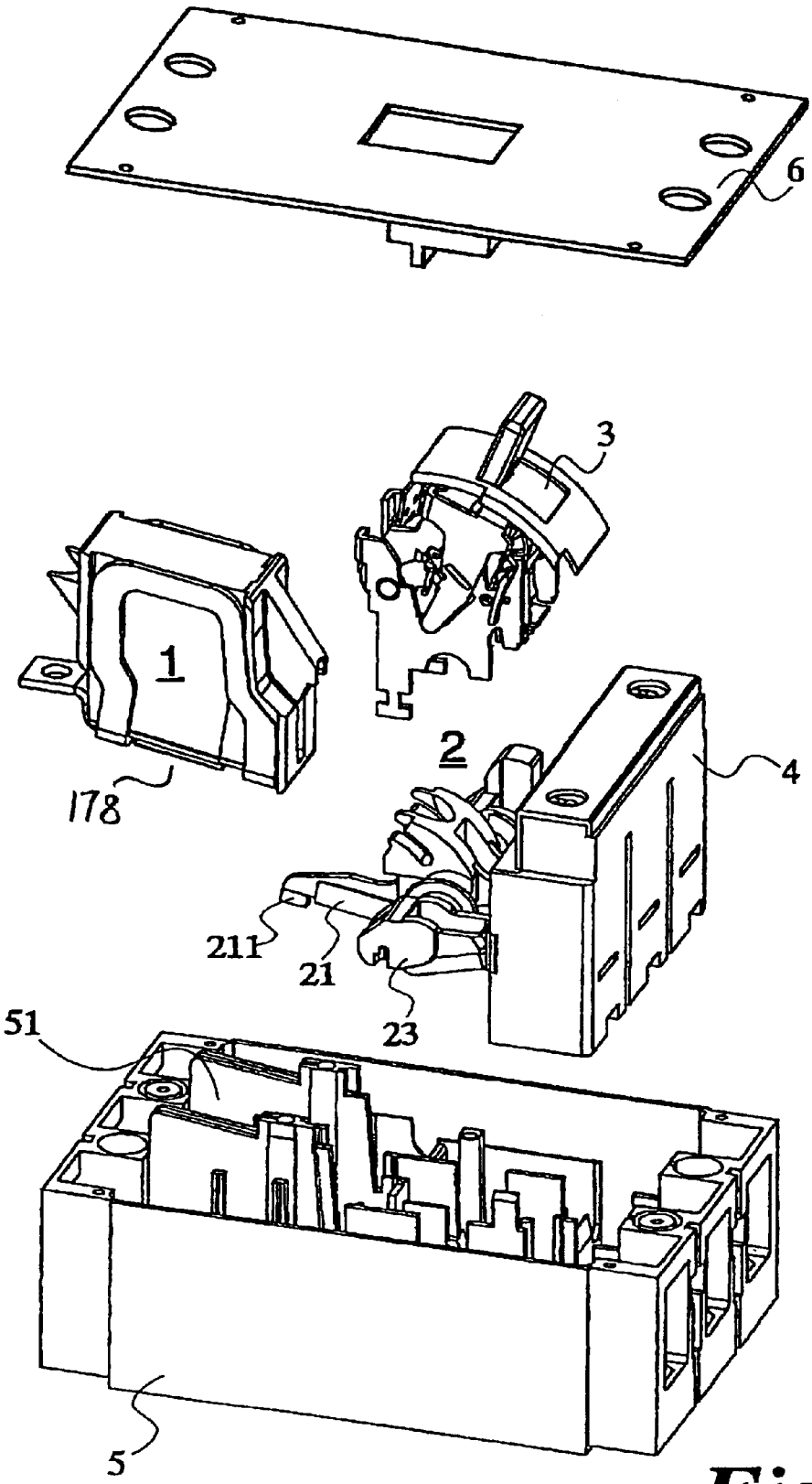
FIG. 1 shows a perspective exploded view of a contact arrangement according to the present invention in connection with a switching device.

An immovable contact arrangement part 1, a movable contact arrangement part 2, an actuating mechanism 3 and a tripping block 4 which are retained by a lower part 5 and an upper part 6 of the switching device enclosure are shown in FIG. 1 as the parts of a three-pole current-limiting circuit breaker only for the middle pole. Actuating mechanism 3 acts upon a switching shaft 23 which extends over all three poles and on which contact arms are pivoted of which, in turn, only contact arm 21 is shown which belongs to the middle pole and features a movable contact 211 at the extremity. In each case one immovable contact arrangement part 1 and one contact arm 21 constitute a contact arrangement along the lines of the present invention. Immovable contact arrangement parts 1 are inserted in chambers 51 of lower part 5.

Figure 2:
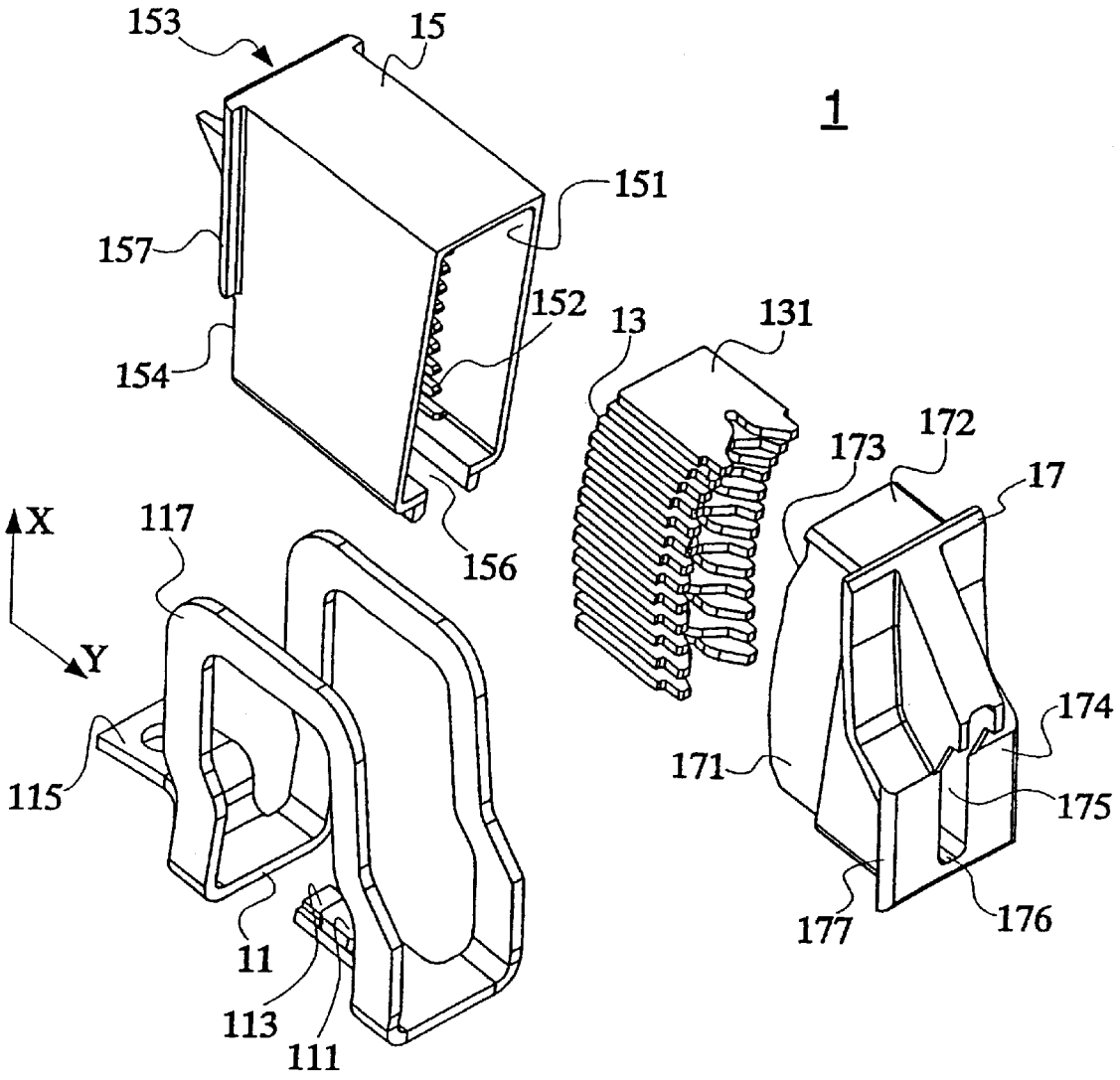
FIG. 2 shows a perspective exploded view of the immovable parts of the contact arrangement of FIG. 1.

According to FIG. 2, contact arrangement part 1 includes a conductor rail 11, an arc control device 13, and a cassette composed of a box-like chamber part 15 and of a box-like cover part 17. At one end, conductor rail 11 includes a stationary contact 111 which moves into or out of contact with movable contact 211 of contact arm 21 as well as an arcing contact 113 and, at the other end, a terminal lug 115. Conductor rail 11 further includes two current loops 117 which are laterally bent away upward from the remaining part of conductor rail 11 and which extend on both side in planes parallel to center plane XY of the contact arrangement and along the entire opening travel of movable contact 211.

Two-part cassette 15, 17 is formed of insulating material and is supported substantially all-around by corresponding inner surfaces of lower part 5 and upper part 6 subsequent to fitting in immovable contact arrangement part 1. The insulating material of which cassette parts 15 and 17 are composed should be a high-quality material in electrical and thermal terms. The switching device enclosure, in contrast, can thus be composed of an ordinary and therefore cheaper material.

Arc splitters 131 of arc control device 13 are retained in the interior of the cassette in a positive-locking manner. At the inner sides 151 facing opposite, chamber part 15 and, for a minor part, cover part 17 have strip-like formations 152 which retain arc splitters 131 at the sides and in a manner that they are spaced from each other. Formations 152 are aligned in such a manner that they do not constitute an obstacle during the removal of the cassette parts from the molds. At back wall 154 of chamber part 15, an exhaust port 153 for developing arcing gasses is provided which is covered in the drawing. When assembling the cassette, cover part 17 partially reaches into chamber part 15 with inserted side walls 171 and 172 and, in doing so, secures arc splitters 131 against longitudinal displacement via its front side 173. At back wall 174 of cover part 17, provision is made for a narrow elongated passage aperture 175 for movable contact arm 21.

The part of conductor rail 11 linked with stationary contact 111 reach into the interior of cassette 15, 17 via an entrance aperture 178. To this end, slots 156 and 176 which are open at one end are provided at the bottom walls of cassette parts 15 and 17, respectively, forming the continuous entrance aperture 178 subsequent to assembly. Current loops 117 and, consequently, the conductor rail are retained in a positive-locking manner at the opposing outer walls of cassette 15, 17. For this purpose, in the region of back walls 154 and 174 facing away from each other of chamber part 15 and cover part 17, guiding strips 157 and 177, respectively, are formed laterally outward on both sides. During the assembly of immovable contact arrangement part 1, conductor rail 11, together with its current loops 117, is slid over assembled cassette 15, 17 between guiding strips 157 and 177 in a straight line and in a direction X leading off from stationary contact 111 substantially perpendicularly, the conductor rail being secured via guiding strips 157 and 177 against displacements in direction Y or in the opposite direction.

The present invention is not limited to the specific embodiments described above. Various modifications and changes may be made without departing from the spirit and scope of the invention as set forth in the claims that follow. Thus, for example, a stop for contact arm 21, which is electrodynarnically thrown open in the event of short-circuit currents, and/or arc-quenching insulating parts may be affixed inside cassette 15, 17 during assembly. For easy handling of immovable contact arrangement part 1, the two cassette parts 15 and 17 can be joined to each other via integrated snap-in locking elements.

What is claimed is:

1. A current-limiting contact arrangement comprising:

a conductor rail including a stationary contact and including two current loops extending at opposite sides of the conductor rail in respective planes parallel to a center plane of the contact arrangement;

a contact arm including a movable contact which can be brought into and out of contact with the stationary contact, the current loops extending in respective planes parallel to a center plane of the contact arrangement thereof and along an entire opening travel of the movable contact;

an arc control device including arc splitters; and a cassette including a first part and a second part and an insulating material, the arc splitters being disposed in a positive-locking manner in an interior of the cassette, the contact arm and a part of the conductor rail including the stationary contact extending into the interior of the cassette, the current loops being disposed in a positive-locking manner at outer walls of the cassette, an assembly of the cassette, the arc splitters and the conductor rail being received in a positive-locking manner by inner surfaces of a switching device enclosure.

2. The contact arrangement as recited in claim 1 wherein the cassette is supported all-around in the switching device enclosure.

3. The contact arrangement as recited in claim 1 wherein the insulating material has a higher quality than a second insulating material included in the switching device enclosure.

4. The contact arrangement as recited in claim 1 wherein the first and second parts of the cassette are capable of being joined to each other via snap-in locking elements.

5. The contact arrangement as recited in claim 1 wherein:

the first part includes a chamber part for receiving the arc splitters in an interior of the chamber so that the arc splitters are spaced from each other, and the first part includes a back wall defining at least one exhaust port for arcing gasses; and the second part includes a box-like cover part, the box-like cover part including side walls partially extending into the chamber part, the side walls including a front side for retaining the arc splitters in a positive-locking manner, the box-like cover part including a back wall defining a narrow passage aperture for the receiving the contact arm.

6. The contact arrangement as recited in claim 1 wherein the first part includes a first inner wall and the second parts includes a second inner wall, the first inner wall including first strip-like members, the second inner wall including second strip-like members, the arc splitters being retained between the first and second strip-like members, the first strip-like members being aligned in a direction of removing the first part from a first mold used to form the first part, the second strip-like members being aligned in a direction of removing the second part from a second mold used to form the second part.

7. The contact arrangement as recited in claim 1 wherein the first and second parts define an aperture, the part of the conductor rail including the stationary contact extending through the entrance aperture.

8. The contact arrangement as recited in claim 1 wherein the first and second parts include respective back walls facing away from each other, respective guiding strips for the current loops being disposed at the back walls and projecting laterally outward.

9. The contact arrangement as recited in claim 1 wherein the conductor rail is capable of being slid over the cassette in a straight line in a direction approximately perpendicular to a surface of the stationary contact.

10. The contact arrangement as recited in claim 1 further comprising a stop for the contact arm disposed inside the cassette in a positive-locking manner.

11. The contact arrangement as recited in claim 1 further comprising arc-quenching insulating parts disposed inside the cassette in a positive-locking manner.

* * * * *